US006486441B1

(12) United States Patent
Chen et al.

(10) Patent No.: US 6,486,441 B1
(45) Date of Patent: Nov. 26, 2002

(54) HEATER MEMBER WITH CONFORMABLE, CURED FLUOROCARBON THERMOPLASTIC RANDOM COPOLYMER OVERCOAT

(75) Inventors: Jiann Hsing Chen, Fairport; Andrew Ciaschi, Lima; Joseph A. Pavlisko, Pittsford; Nataly Boulatnikov, Ontario, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/011,388

(22) Filed: Dec. 4, 2001

(51) Int. Cl.[7] ..... H05B 3/00; G03G 15/20
(52) U.S. Cl. ..... 219/216; 219/469; 399/333
(58) Field of Search ..... 219/216, 469; 399/333; 432/60, 228; 492/46; 118/60

(56) References Cited

U.S. PATENT DOCUMENTS 5,464,698 A * 11/1995 Chen et al. ..... 219/216
5,595,823 A * 1/1997 Chen et al. ..... 428/421
5,781,840 A * 7/1998 Chen et al. ..... 399/333
6,011,946 A * 1/2000 Eddy et al. ..... 399/333
6,041,210 A * 3/2000 Chen et al. ..... 399/333
6,096,429 A * 8/2000 Chen et al. ..... 399/333
6,159,588 A * 12/2000 Eddy et al. ..... 399/333
6,183,929 B1 * 2/2001 Chow et al. ..... 399/333
6,342,689 B1 * 1/2002 Ishigaki et al. ..... 219/216

* cited by examiner

*Primary Examiner*—Joseph Pelham
(74) *Attorney, Agent, or Firm*—Laurence P. Kessler

(57) ABSTRACT

Disclosed is an externally heated, external heater member for transferring heat to a fusing member used to heat fix a toner image to a substrate, such as a fuser employed in an electrophotographic process. The heater member includes:

a core;

a conformable base cushion layer overlying the core; and an outer layer overlying the base cushion layer, the outer layer comprising a cured fluorocarbon thermoplastic random copolymer. In embodiments, the copolymer has subunits of:

$$-(CH_2CF_2)x-,\ -(CF_2CF(CF_3))y-,\ \text{and}\ -(CF_2CF_2)z-,$$

wherein x is from 1 to 50 or 60 to 80 mole percent,
y is from 10 to 90 mole percent,
z is from 10 to 90 mole percent,
x+y+z equals 100 mole percent.

47 Claims, 5 Drawing Sheets

HEATER MEMBER WITH CONFORMABLE, CURED FLUOROCARBON THERMOPLASTIC RANDOM COPOLYMER OVERCOAT

CROSS REFERENCE TO RELATED APPLICATIONS

Copending U.S. patent application Ser. No. 10/011,793 filed concurrently on even date herewith and entitled "External Heater Member and Methods For Fusing Toner Images", is a related application which is incorporated herein by reference in its entirety.

Attention is also directed to the following copending U.S. patent application Ser. Nos. 09/609,561; 09/607,731; 09/608,290; and 09/697,418 filed on Jun. 30, 2000 directed to cured fluorocarbon thermoplastic copolymer compositions, as well as U.S. patent application Ser. Nos. 09/609,562; 09/608,289; 09/608,362; and 09/608,818 also filed on Jun. 30, 2000 directed to catalysts and low-temperature cure fluorocarbon thermoplastic copolymer compositions. The teachings of each of the above-described applications are hereby incorporated by reference in their entirety.

FIELD OF THE INVENTION

This invention relates generally to members useful in fusing apparatus for heat-fixing a heat-softenable toner material to a substrate. More particularly, the invention relates to a heater member useful for transferring heat to a fuser member in said fusing apparatus, wherein the heater member is externally heated and has an overcoat layer thereon comprised of a cured fluorocarbon thermoplastic copolymer composition described hereinafter.

BACKGROUND OF THE INVENTION

Heat-softenable toners are widely used in imaging methods such as electrostatography, wherein electrically charged toner particles are deposited imagewise on a dielectric or photoconductive element bearing an electrostatic latent image. Most often in such methods, the toner is then transferred to a surface of another substrate, such as a receiver sheet comprising paper or a transparent film, where it is then fixed in place to yield a final desired toner image.

When heat-softenable toners, comprising for example thermoplastic polymeric binders, are employed, the usual method of fixing the toner in place involves applying heat to the toner once it is on the receiver sheet surface to soften it, and then allowing or causing the toner to cool.

One such fusing method comprises passing the toner-bearing receiver sheet through a nip formed by a pair of opposing members, typically in the form of cylindrical rollers, wherein at least one of the members (usually referred to as a fuser member) is heated and contacts the toner-bearing surface of the receiver sheet in order to heat and soften the toner. The other member (usually referred to as a pressure member) serves to press the receiver sheet into contact with the fuser member. In some other fusing methods, the configuration is varied and the "fuser member" or "pressure member" can take the form of a flat plate or belt. The description herein, while directed to a generally cylindrical fuser roller in combination with a generally cylindrical pressure roller, should not be construed as limited to such a roller configuration.

The fuser member typically comprises a rigid core covered with a resilient material, which can be referred to as a base cushion. The resilient base cushion and the amount of pressure exerted by the pressure member serve to establish an area of contact for the fuser member with the toner-bearing surface of the receiver sheet as it passes through the nip formed by contact of the fuser member with the pressure member. The size of this area of contact helps establish the length of time that any given portion of the toner image will be in contact with and heated by the fuser member. The degree of hardness (often referred to as "storage modulus") and stability thereof, of the base cushion are important factors in establishing and maintaining the desired area of contact for fusing.

In some prior fusing systems, it has been advantageous to vary the pressure exerted by the pressure member against the receiver sheet and fuser member. This variation in pressure can be provided, for example in a fusing system having a pressure roll and a fuser roll, by slightly modifying the shape of the pressure roll. The variance of pressure, in the form of a gradient of pressure that changes along the direction through the nip that is parallel to the axes of the rolls, can be established, for example, by continuously varying the overall diameter of the pressure roll along the direction of its axis such that the diameter is smallest at the midpoint of the axis and largest at the ends of the axis, in order to give the pressure roll a subtle "bow tie" or "hourglass" shape. This causes the pair of rolls to exert more pressure on the receiver sheet in the nip in the areas near the ends of the rolls than in the area about the midpoint of the rolls. This gradient of pressure helps to prevent wrinkles and cockle in the receiver sheet as it passes through the nip. Over time, however, the fuser roll begins to permanently deform to conform to the shape of the pressure roll and the gradient of pressure is reduced or lost, along with its attendant benefits. It has been found that permanent deformation (alternatively referred to as "creep") of the base cushion of the fuser member is a contributor to this problem.

While some fuser members are internally heated by placing a quartz lamp or other type of heat source internally within the fuser core, fuser members can also be externally heated by use of one or more external heater members, i.e., rollers, belts, plates or the like, placed in an opposed, contacting relationship with the fuser member. External heater members for fuser members can themselves be internally heated by use of a quartz lamp or other heat source. Apparatus for externally heating a heater member by a radiant heat source are disclosed in copending U.S. patent application Ser. Nos. 09/500,826 and 09/501,459 filed on Feb. 10, 2000, the teachings of which are incorporated herein by reference.

Heater members which are internally heated and used commercially have either an anodized surface or a very thin fluoropolymer resin, i.e., Teflon® fluorocarbon available from E.I. DuPont deNemours and Co. of Wilmington, Del., coating thereon, both of which have very low thermal resistance due to the relative thinness of such coatings. However, such heater members, when used in an opposed and contacting relationship adjacent to a fuser member, are not resilient or conformable, and therefore, do not allow for a relatively large area of contact (referred to as a "nip width" hereinafter) with the fuser member when a nip is formed by contact of the heater member with the fuser member. Further, such coatings also have little or no ability to store heat. This arrangement results in inefficient heat transfer and undesirable heat loss.

A greater area of contact between the heater member and fuser member would allow for greater and more efficient heat transfer to the surface of the fuser member. To achieve a longer nip width, a conformable elastomer layer could be applied to the heater member. For internally heated heater members, however, a disadvantage with the use of such an elastomer layer is that it could create a time delay for heat energy to transfer to the surface of the heater member due to an increase in thermal resistance. A time delay would increase thermal response time when altering the fuser member surface temperature for any process reason. This increase in thermal response time could preclude the use of image gloss control by making changes in the fuser member temperature, or gloss and fusion tuning for various receiver types. Various receiver types, such as papers or films, have different thermal properties that can affect gloss and fusion quality. Having the ability to change the fuser member surface temperature rapidly within the time between consecutive receiver sheets allows fusion and gloss to be tuned to receivers within a document run that are of different types without reducing the productivity of the entire electrophotographic system. The foregoing ability to control gloss is particularly important for color electrophotographic systems.

U.S. patent application Ser. No. 09/501,459 previously mentioned herein, discloses a heater member which is externally heated and comprised of a core; a fluoroelastomer foam layer, such as Viton® fluoroelastomer available from DuPont, overlying the core; and an outer cured poly (perfluoromethylvinylether) layer thereover, such as a Kalreze® polymer also available from DuPont. While this externally heated heater roller is an improvement over prior commercially used internally heated heater rollers, the fluoroelastomer foam layer disclosed therein may not have sufficient mechanical strength in some apparatus designs to withstand stress imposed by what is known in the art as "velocity overdrive". As a result, the polymeric layers placed over the core could delaminate therefrom, thereby causing premature failure. Further, the poly (perfluoromethylvinylether) material is difficult to dissolve in commonly used solvents, thereby making it difficult to solvent coat onto the foam base cushion overlying the core. As a result, a sleeve of the material must generally be extruded and thereafter bonded to the foam base cushion, or molded and thermally bonded to the foam base cushion at high temperatures. These methods are generally more difficult to perform than solvent coating methods.

As can be seen, there is a need for a heater member, capable of being externally heated by a radiant heat source, which has a nip width, i.e., contact area, which can be set and/or varied so as to maximize and/or optimize heat transfer to the surface of an associated fuser member. It would also be desirable for the heater member to have an outer polymeric layer thereon in contact with the fuser member which is not only thermally stable, but also mechanically stable and more easily formed than other methods known to the art.

SUMMARY OF THE INVENTION

It is an object of the present invention to provide a heater member, capable of being externally heated by a heat source, which overcomes the limitations and disadvantages described hereinabove. It is a further object of the present invention to provide a heater member which is particularly suitable for external heating by a radiant source, and for use, for example, in an axially unsupported configuration in a fusing apparatus. According to the present invention, direct heating of the heater member surface allows for rapid changes in fuser and heater member surface temperatures, so as to alter the fusing process and provide gloss and/or image quality control between consecutive jobs and/or receiver sheets.

A method to accomplish the foregoing objectives according to the present invention employs an externally heated external heater member to impart thermal energy to a fuser member through conduction, i.e., by direct contact. The heater member has a conformable base cushion layer to increase nip width, i.e., contact width, and heating time, with the fuser member. The heater member is heated by an external radiant heat source, which imparts heat energy directly to the heater member surface and not solely by indirect heating means through the heater member core and overlying elastomer layer.

Thus, in one aspect, the present invention relates to a heater member for transferring heat to a fusing member used to heat fix a toner image to a substrate. The heater member comprises:

a core;

a conformable base cushion layer overlying the core; and an outer layer overlying the base cushion layer, wherein the outer layer comprises a cured fluorocarbon thermoplastic random copolymer.

In embodiments, the invention relates to a heater member for transferring heat to a fusing member used to heat fix a toner image to a substrate. The heater member comprises:

a core;

a conformable base cushion layer overlying the core; and an outer layer overlying the base cushion layer, where the outer layer comprises a cured fluorocarbon thermoplastic random copolymer having subunits of:

$$—(CH_2CF_2)x—,\ —(CF_2CF(CF_3))y—,\ \text{and}\ —(CF_2CF_2)z—,$$

wherein:

x is from 1 to 50 or 60 to 80 mole percent, y is from 10 to 90 mole percent, z is from 10 to 90 mole percent, and x+y+z equals 100 mole percent.

The present invention provides an ability to change the fuser member surface-temperature during operation, thereby allowing for gloss and/or image quality control. It also provides better thermal droop management for the overall fusing system, so that it is not necessary to artificially increase and decrease the fusing member surface temperature to increase the stored energy within the fuser member, while trying to maintain a desired fusing temperature-control set-point.

The external radiant heat feature, particularly in combination with a preferred, relatively low thermal conductivity (i.e., thermally insulating) conformable base cushion layer as described hereinafter, can allow internal components within the heater member to remain cooler in comparison to an internally heated heater member system, which could either increase component life or reduce component cost if the component life requirement otherwise remains the same.

Another advantage of the present invention is that the cured fluorocarbon thermoplastic random copolymer materials employed allow for a relatively large temperature gradient to be formed between the surfaces of the fuser member and heater member, so as to increase available heat time or dwell.

Another advantage is that use of a preferred poly (organosiloxane) base cushion layer as described hereinafter allows for mechanical stability and also sufficient compression characteristics so that the resulting heater member has a conformable outer surface which can be adapted to form contact, i.e., pressure, nips of increased width and, therefore, greater surface area for heat transfer, with the associated benefits and advantages as previously described. A greater nip width allows more nip time and thereby enables high volume (or high speed) heating of the fuser member surface without undesirable thermal droop. The preferred silicone base cushion also generally allows for a pressure nip with significantly less velocity overdrive, which reduces relative motion in the nip, therefore reducing fuser member surface wear.

DETAILED DESCRIPTION OF THE INVENTION

The present invention relates to an externally heated, external heater member for heating a fuser member and/or pressure member in an electrophotographic process and/or apparatus, wherein the heater member comprises a core member coated with a base cushion layer. Disposed over the base cushion layer is an overcoat of a cured polymeric composition comprising a fluorocarbon thermoplastic random copolymer. In embodiments, the copolymer comprises a fluorocarbon thermoplastic random copolymer, a cure agent having a bisphenol residue therein, a particulate filler containing zinc oxide, an aminosiloxane, and optionally, a thermally conductive filler. The heater member is described in more detail hereinafter.

Figure 1:
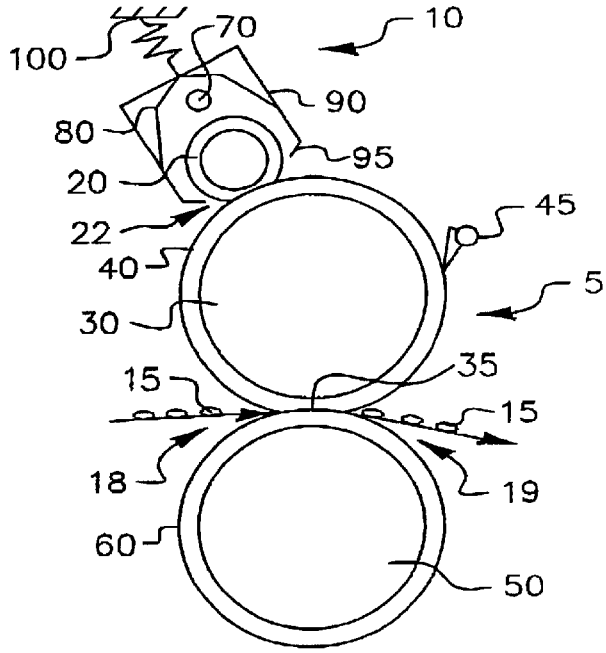
FIG. 1 is a schematic front cross-sectional view of a 2-pass fuser assembly which includes an externally heated external heater member subsystem in accordance with the present invention.

Referring now to FIG. 1, a 2-pass fuser assembly 5 is shown which incorporates an externally heated external heater member subsystem 10 in accordance with the present invention. The 2-pass fuser assembly 5 also includes a fuser member 30 and pressure member 50 which are in an opposed and contacting relationship such that they form a fusing nip 35. A receiver sheet 15, such as paper or film, bearing a toner image thereon, enters the fusing nip 35 at a receiver entrance point 18 and exits at a receiver exit point 19. In a 2-pass fuser assembly as shown in FIG. 1, in order to perform duplex (2-sided) printing, after the receiver sheet passes through fusing nip 35 on a first pass, it is necessary to reverse the orientation of the receiver sheet (as known within the art) and run the receiver sheet through the fuser assembly a second time in order to fix a toner image on both sides of the receiver sheet. A finger skive 45 that precedes the heater member 20 on fuser member 30 can be used to separate a receiver sheet 15 from the fuser member 30, if the receiver sheet should stick thereto after going through receiver exit point 19, such that the receiver sheet 15 does not contact or lodge in close proximity to the externally heated external heater member subsystem 10. The finger skive 45 would peel-off the receiver sheet 15 before it reaches the heater member 20.

The fuser member 30 can be made of any materials known to the art; generally it comprises an outer surface 40 comprised of a material which preferably uses or can use a polymeric release agent as described hereinafter. Similarly, pressure member 50 can be made of any materials known in the art, and it has an outer surface 60. Generally, the outer surface 40 of the fuser member 30 and the outer surface 60 of pressure member 50 comprise a polymeric elastomer material, such as silicone elastomers, fluoroelastomers like Viton® A or Viton® B fluoroelastomers available from DuPont, and so-called interpenetrating networks of silicone and fluoroelastomers. Such materials are disclosed, for example, in U.S. Pat. Nos. 5,141,788; 5,166,031; 5,281,506; 5,366,772; 5,370,931; 5,480,938; 5,846,643; 5,918,098; 6,037,092; 6,099,673; and 6,159,588, the teachings of which are incorporated herein by reference. Another type of suitable material is a fluorocarbon-based, cured thermoplastic random copolymer material, which in preferred embodiments is a cured THV thermoplastic fluoropolymer, such as those cured polymer materials disclosed in copending U.S. Patent Application entitled "FLUOROCARBON THERMOPLASTIC RANDOM COPOLYMER COMPOSITION", U.S. patent application Ser. No. 09/609,561, filed Jun. 30, 2000, the teachings of which have already been incorporated herein by reference in their entirety.

In some fusing systems, a release agent oil, such as a poly(dimethylsiloxane) oil, is used to prevent toner offset, that is, to aid the fuser member in releasing toner particles that may adhere thereto during the fusing operation. During use, the oil can be continuously coated onto the surface of the fuser member in contact with the toner image, as is known in the art. The heater member herein can be used with any release agent known in the art, such as a polydimethylsiloxane or mercapto-, amino-, carboxy-, hydroxy-, isocyanate-, epoxy-, thioether-, or hydride-functionalized polydimethylsiloxane release oils at normally used application rates or at reduced application rates, such as from about 0.5 mg/copy to 10 mg/copy for a typical 8.5 inch by 11 inch bond paper.

Figure 2:
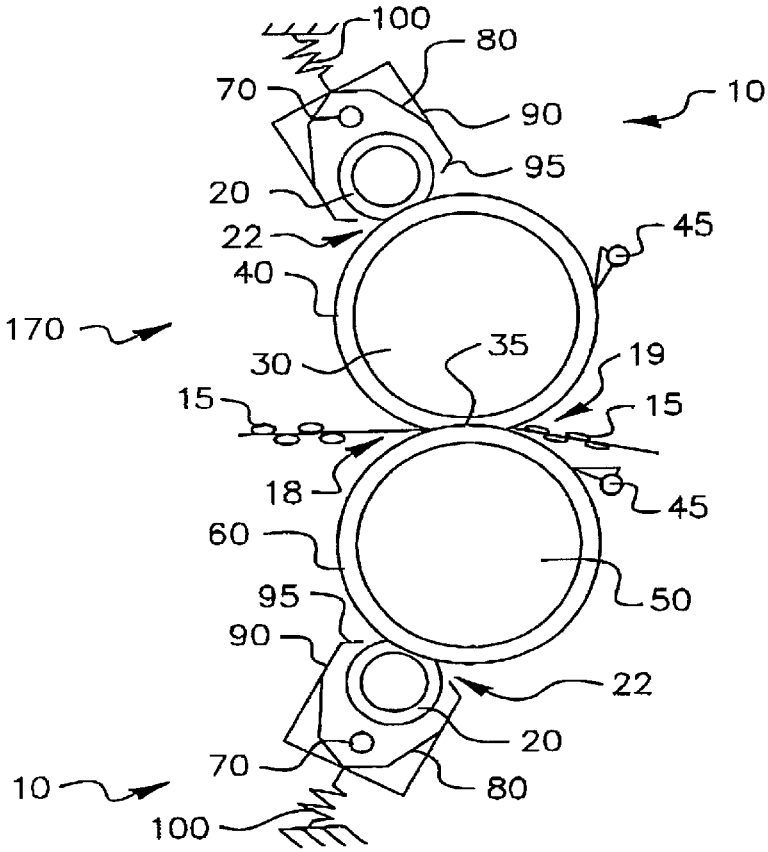
FIG. 2 is a schematic front cross-sectional view of a 1-pass fuser assembly which includes an externally heated external heater member subsystem in accordance with the present invention.

The externally heated external heater member subsystem 10 comprises a heater member 20, a radiant heat source 70, a reflector 80 which can be elliptical or parabolic, a radiation shield 90, a shield extension member 95, and supporting structures and bearings (not shown). As with the fuser member and pressure member, the heater member 20 is oriented in an opposed and contacting relationship (as shown in FIGS. 1 and 2) adjacent to the fuser member 30 such that a contact nip 22 is formed therebetween. The externally heated external heater member subsystem 10 has a loading system 100 associated therewith to facilitate formation of contact nip 22 between the heater member 20 and fuser member 30.

Loading system 100 useful in practicing the invention, can take the form of any loading system known in the fusing art for orienting fuser members with pressure members so as to create a fusing nip, such as a constant force load or a constant displacement load system. Preferably, the loading system 100 employs a constant force load by use of air or other fluid actuated pneumatic cylinders having a source of air or other fluid in fluid communication therewith and maintained at constant pressure. The loading system 100 can be controlled with a feed back control loop (not shown) that senses (or knows by operator input) the type of receiver sheet 15 entering the fuser assembly 5, which sends a signal to a fuser thermal controller (not shown) which calculates the amount of heat necessary to transfer to the heater member 20, and which controller also sends a signal to a power regulator (not shown) which varies the power input to radiant heat source 70. Alternatively, and preferably, in addition to varying the power input to the radiant heat source, a signal can also be sent to a fuser load controller (not shown) which controls loading system 100, such as the air or other fluid sent to the pneumatic cylinder by a compressor, so that the contact nip 22 can be varied in width and thereby vary the contact area. In this way, energy transferred to the toned receiver sheet can be modulated by either adjusting (i.e., adding or reducing) the amount of radiant heat energy passed to the heater member 20, adjusting (i.e., increasing or reducing) the nip residence time by adjusting the nip forming load which translates to an adjustment (i.e., increase or decrease) in the contact nip width, or by a combination of these two types of adjustments; whereby heat input to the fuser member can be varied depending on the type of receiver sheet 15 employed so that gloss and image quality can be adjusted.

A preferred location for the externally heated external heater member subsystem 10 would be one closer to the receiver entrance point 18 of the fusing nip 35, since such a location is more thermally efficient (due to less thermal energy loss prior to transfer of heat to the receiver sheet 15) than a location farther away from the receiver entrance point 18. However, the location should not be so close as to interfere with other subsystems that may be associated with the fuser assembly.

Alternatively, the externally heated external heater member subsystem 10 can also be employed in a 1-pass fuser assembly 170 as is shown in FIG. 2, wherein toner images on both sides of a receiver sheet 15 can be fused in a single pass of the receiver through fuser assembly 170. In FIG. 2, the reference numerals used for FIG. 1 have been retained for purposes of convenience. In FIG. 2, both the fuser member 30 and pressure member 50 are each separately heated by an externally heated external heater member subsystem 10 as shown. As a result, duplex prints with toner images present on both sides of receiver sheet 15 can be fixed in a single pass of the receiver through the fuser assembly 170.

More than one externally heated external heater member subsystem 10 can be used to heat either the fuser member 30 or pressure member 50 in FIGS. 1–2 so as to increase the overall heating rate into the fusing assembly.

In a fuser assembly, the fuser member 30 and pressure member 50 are preferably configured to have a thicker layer of elastomer on the fuser member 30 as opposed to the pressure member 50. This elastomer configuration in a single-pass fusing assembly as shown in FIG. 2 causes the receiver sheet 15 to exit the fusing nip 35 at receiver exit point 19 in a direction angled slightly towards the pressure member 50 as shown in FIG. 2. Having the receiver sheet 15 exit slightly toward the pressure member 50 is desired, since finger skives (preferably made of Viton® fluoroelastomers from DuPont) are generally used to keep receiver sheets from sticking to the pressure member after the receiver sheet exits the fuser assembly. Such fluoroelastomer skives generally do not compromise image quality of the fused toner image on the receiver sheet. Having different thicknesses of elastomer on each member creates different thermal resistances for each member; and, therefore, each member (30 and 50) will absorb heat at a different rate. To compensate for the different heating rates, the external heater members 20 could be loaded differently to create contact nips 22 with differing amounts of contact area. Differently sized contact nips 22 will result in differences in heating time, which allows for different heating rates to compensate for the different elastomer thickness on each member (30 and 50). Alternatively, the amount of optional thermally conductive filler employed in each elastomer layer, using the fillers as taught for example in U.S. Pat. No. 5,595,823, the teachings of which are incorporated herein by reference, can be adjusted to obtain a tailored thermal conductivity which can provide a desired heat rate for the member in question.

Figure 3:
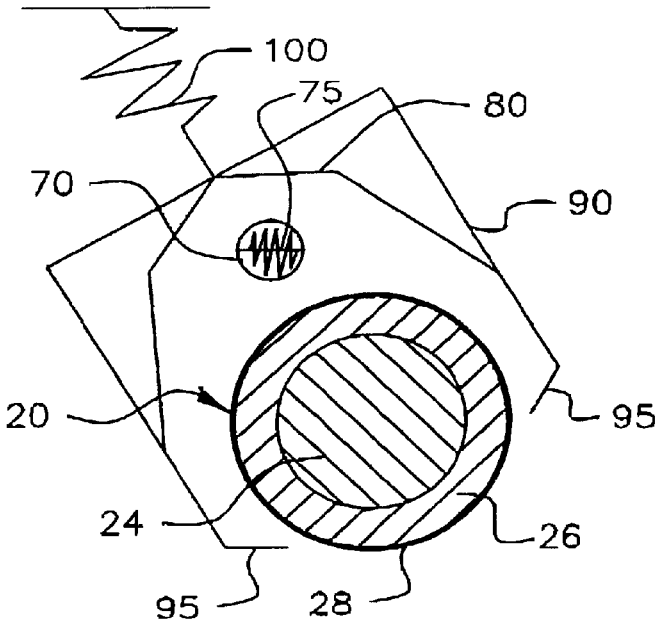
FIG. 3 is a cross-sectional view of a preferred embodiment of the externally heated external heater member subsystem shown in FIG. 1.

Referring now also to FIG. 3, which depicts an externally heated external heater member subsystem 10 shown in FIGS. 1–2, the same reference numerals referenced in FIGS. 1–2 have been retained for convenience. The radiant heat source 70 is preferably a quartz tube comprised of an electrically resistive internal Joule heating element 75, but can be any infrared heat element known to the art. This type of heat source emits infrared energy that is relatively evenly distributed across the length of the heater member 20 in FIGS. 1–3 and easily absorbed by heater member 20. The heating element 75 also preferably has low thermal mass for quick heat-up and cool-down; but any type of infrared radiant heat source could be used, such as ceramic panels, quartz lamps, and electrically resistive metal rods and bars. The reflector 80 assists with directing heat energy toward the heater member 20, and can be fabricated from polished aluminum sheet metal. The radiation shield 90 is a safety and energy efficiency feature which assists with containing heat energy within the confines of externally heated external heater member subsystem 10. The radiation shield 90 can be fabricated of polished aluminum sheet metal. The radiation shield extension 95 is generally made from the same material and is part of the radiation shield 90 as shown in FIGS. 1–4. The radiation shield extension 95 is also desirable for containing heat energy and concentrating heat energy onto the area of the heater member 20 exposed to the radiant heat source 70.

In a preferred configuration, the heater member 20 would use a poly(organosiloxane) base cushion 26 (which is conformable) with a thin outer layer 28 of cured fluorocarbon thermoplastic random copolymer, which copolymer can include thermally conductive filler, all of which is described hereinafter. The cured fluorocarbon thermoplastic random copolymer is a high-temperature resistant polymeric material, i.e., a material capable of retaining mechanical strength and shape (without undesirable creep) at temperatures of up to 300° C. The poly(organosiloxane) base cushion 26 facilitates formation of a contact nip 22 with a nip width that can be set or adjusted to obtain a desired heating time. It also allows for a contact nip with little to no velocity overdrive due to compressibility of the poly (organosiloxane). The outer layer 28 is preferably non-porous and smooth to allow maximum thermal contact area, cleaning-ability, and so as to not disturb any layer of release agent oil on the fuser member to a point that oil image artifact patterns are transferred to the toner image being fused. The cured fluorocarbon thermoplastic random copolymer as described hereinafter can withstand continuous operating fusing temperatures of from about 200° C. and up to a maximum of about 300° C. The outer layer 28, in preferred embodiments wherein the thermal conductivity of the outer layer is higher (such as a difference in thermal conductivity of at least about 0.1 BTU/hr-ft-° F.) than the thermal conductivity of the base cushion, is able to transfer heat rapidly to the fuser member; while the base cushion, particularly for preferred embodiments wherein the base cushion is a poly(organosiloxane) polymer with a thermal conductivity of about 0.15 BTU/hr-ft-° F. or less, is in comparison essentially a thermal insulator. This configuration of thermal conductivity allows heat to be stored, most efficiently, in the outer layer 28 rather than the base cushion layer.

Figure 4:
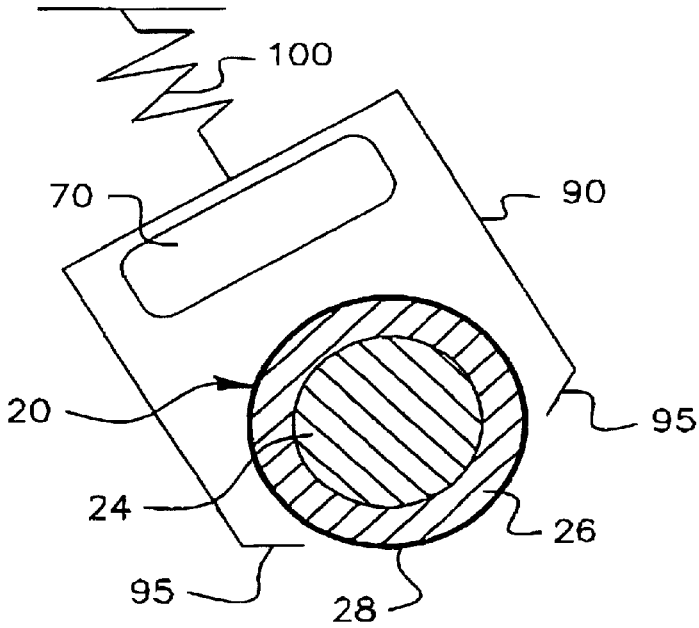
FIG. 4 is a cross-sectional view of an alternate embodiment for the externally heated external heater member subsystem shown in FIG. 1.

In FIG. 4, an alternative embodiment of the externally heated external heater member subsystem 10 is shown, wherein the radiant heat source 70 is in the form of a ceramic panel heater available from Watlow Corporation of LeRoy, N.Y. Also suitable as the radiant heat source 70 is a carbon fiber heating element, or standard quartz tube or lamp.

The heater member 20 comprises a core 24 which can be of any material which is mechanically and dimensionally stable at the operating temperatures employed for the externally heated external heater member subsystem 10. For example, the core 24 can be made of a high-temperature resistant plastic material like polyamide-imides, or a metal like aluminum. Preferably, the core 24 is steel or stainless steel, and alloys thereof, which is preferably in a cylindrically shaped hollow tube or solid rod form. In FIGS. 3 and 4, the core 24 is shown to be a solid cylindrical rod shape, with heat being supplied by external means, i.e., radiant heat source 70. However, a heat source provided within core 24 (not shown), such as through use of a quartz lamp, can also be provided for purposes of, for example, providing baseline heating while the fuser assembly is in standby operational modes. During normal operation, the external radiant heat source can provide additional heat input.

The base cushion layer 26, as illustrated by FIGS. 3–4, is suitably constructed of a conformable, complaint material so as to generate a desirable contact area, such as a nip width of from about 5 to about 20 millimeters, preferably from about 7 to about 17 millimeters (mm), as illustrated in the examples described hereinafter, within contact nip 22. By the term "nip width", it is meant the length along the perimeter of the outer surface of fuser member 30 or pressure member 50 in contact with the outer surface of heater member 20. The term "contact area" refers to the area of contact between the fuser member or pressure member, as the case may be, and the heater member; in other words, the nip width times the length of contact with the fuser member or pressure member. Preferably, the compliant material is a polymeric elastomer described hereinafter, and preferably a silicone elastomer so as to provide not only a conformable, compliant material, but also high temperature resistance and mechanical stability.

In general, the thickness of the combined base cushion layer and outer layer is desirably from between about 100 mils to about 900 mils. Each layer is described below.

Outer Layer

According to the present invention, outer layer 28 comprises a cured fluorocarbon thermoplastic random copolymer, such as those copolymers disclosed in U.S. patent application Ser. No. 09/609,561 filed Jun. 30, 2000, the teachings of which have been incorporated herein by reference in their entirety. By "cured", it is meant that the fluorocarbon thermoplastic random copolymer starting material is reacted with curing agents such that it is no longer thermoplastic in nature and retains its shape at elevated temperatures typically employed in fusing systems. In general, the cured fluorocarbon random copolymer has subunits of the following:

$$—(CH_2CF_2)x—,\ —(CF_2CF(CF_3))y—,\ \text{and}\ —(CF_2CF_2)z—$$

wherein:

x is from about 1 to about 50 or from about 60 to about 80 mole percent, y is from about 10 to about 90 mole percent, z is from about 10 to about 90 mole percent, and x+y+z equals 100 mole percent.

The foregoing subunits can also be described as follows:

$—(CH_2CF_2)—$ is a vinylidene fluoride subunit ("$VF_2$"), $—(CF_2CF(CF_3))—$ is a hexafluoropropylene subunit ("HFP"), and $—(CF_2CF_2)—$ is a tetrafluoroethylene subunit ("TFE").

In the above formulas, x, y, and z are mole percentages of the individual subunits relative to a total of the three subunits (x+y+z), referred to herein as "subunit mole percentages". The curing agent can be considered to provide an additional "cure-site subunit"; however, the contribution of these cure-site subunits is not considered in subunit mole percentages. In the fluorocarbon thermoplastic copolymer, x has a subunit mole percentage of from about 1 to about 50 or about 60 to about 80 mole percent, y has a subunit mole percentage of from about 10 to about 90 mole percent, and z has a subunit mole percentage of from about 10 to about 90 mole percent. In a currently preferred embodiment, subunit mole percentages are: x is from about 30 to about 50 or about 70 to about 80, y is from about 10 to about 20, and z is from about 10 to about 50; or more preferably x is from about 40 to about 50, y is from about 10 to about 15, and z is about 40 to about 50. In the currently preferred embodiments, x, y, and z are selected such that fluorine atoms represent at least about 65 mole percent of the total formula weight of the $VF_2$, HFP, and TFE subunits.

Suitable fluorocarbon thermoplastic random copolymers (in uncured form) employed in practicing the invention are available commercially. In a particular embodiment of the invention, a vinylidene fluoride-co-tetrafluoroethylene-co-hexafluoropropylene was used which can be represented as -(VF)(75)-(TFE)(10)-(HFP)(25)-. This material is marketed by Hoechst Company under the designation "THV Fluoroplastics" and is referred to herein as "THV". In another embodiment, a vinylidene fluoride-co-tetrafluoroethylene-co-hexafluoropropylene was used which can be represented as -(VF)(49)-(TFE)(41)-(HFP)(10)-. This material is marketed by Minnesota Mining and Manufacturing, St. Paul, Minn., under the designation "3M THV" and is referred to herein as "THV-200A". Other suitable uncured vinylidene fluoride-cohexafluoropropylenes and vinylidene fluoride-co-tetrafluoroethylene-cohexafluoropropylenes are available, for example, as THV-400, THV-500, and THV-300, also from 3M.

In general, THV fluoroplastics are set apart from other melt-processable fluoroplastics by a combination of high flexibility and low processing temperatures. With flexural modulus values between 83 Mpa and 207 Mpa, THV fluoroplastics are generally the most flexible of the fluoroplastics.

The molecular weight of the uncured polymer is largely a matter of convenience, however, an excessively large or excessively small molecular weight would create problems, the nature of which are well known to those skilled in the art. In a preferred embodiment of the invention the uncured polymer has a number average molecular weight in the range of about 100,000 to 200,000.

The curing agent is preferably a bisphenol residue. By the term "bisphenol residue", it is meant bisphenol or a derivative such as bisphenol AF. The composition of outer layer 28 further includes a particulate reactive filler including zinc oxide, and also an aminosiloxane. The aminosiloxane is preferably an amino-functionalized poly(dimethylsiloxane) copolymer, more preferably an amino-functionalized poly (dimethylsiloxane) (due to availability) comprising amino-functional units selected from the group consisting of (aminoethylaminopropyl) methyl, (aminopropyl) methyl and (aminopropyl) dimethyl.

An optional release additive such as a fluorinated resin like polytetrafluoroethylene (PTFE) or polyfluoroethylenepropylene (FEP) can be incorporated into the fluorocarbon thermoplastic random copolymer-containing compositions to enhance surface lubricity, cleanability, and reduce potential contamination caused by toner offset. These fluorinated resins are commercially available from Dupont. Fluorinated resins can have a number average molecular weight of from about 50,000 to about 50,000,000, preferably from about 200,000 to about 1,000,000.

A preferred class of curable amino-functional siloxanes, based on availability, includes those having functional groups such as aminopropyl or aminoethylaminopropyl pendant from a poly(siloxane) backbone (more preferably a poly(dimethylsiloxane) backbone), such as DMS-A11, DMS-A12, DMS-A15, DMS-A21 and DMS-A32 (all sold by Gelest, Inc. of Tullytown, Pa.) having a number average molecular weight between 850 and 27,000. Examples of preferred curable amino-functional polydimethyl siloxanes are bis(aminopropyl) terminated poly(dimethylsiloxanes). Such oligomers are available in a series of molecular weights as disclosed, for example, by Yilgor et al., in "Segmented Organosiloxane Copolymer", Polymer, 1984, V.25, pp 1800–1806. Other curable amino-functional polydimethyl siloxanes that can be used are disclosed in U.S. Pat. Nos. 4,853,737 and 5,157,445, the disclosures of which are also hereby incorporated by reference.

The cured fluorocarbon thermoplastic random copolymer compositions include a reactive particulate filler comprising zinc oxide. The zinc oxide particles can be obtained from any convenient commercial source, such as Atlantic Equipment Engineers of Bergenfield, N.J. In a currently preferred embodiment, the particulate zinc oxide filler has a total concentration in the compositions of the invention of from about 1 to 20 parts per hundred parts by weight of the fluorocarbon thermoplastic random copolymer (pph). In a particular embodiment of the invention, the composition has about 3 to 15 pph of zinc oxide.

The particle size of the zinc oxide filler does not appear to be critical. Particle sizes anywhere in the range of about 0.1 to 100 micrometers are acceptable.

In addition to using zinc oxide filler as provided hereinabove, antimony-doped tin oxide particles can be added as a catalyst so that curing of the fluorocarbon thermoplastic random copolymer can be achieved with shorter reaction times and/or at temperatures of as low as room temperature, i.e., about 25° C. This technique is disclosed in copending U.S. patent application Ser. No. 09/609,562 filed Jun. 30, 2000, the teachings of which have been incorporated herein by reference in their entirety. Antimony-doped tin oxide particles can be obtained from Keeling & Walker, Stoke-on-Trent, UK; E.I DuPont deNemours and Co. of Wilmington, Del., or Mitsubishi Metals, Inc. of Japan. A preferred amount of such antimony-doped tin oxide is from about 3 to about 20 pph by weight of the fluorocarbon thermoplastic random copolymer composition employed, and more preferably from about 3 to about 15 pph. The amount of antimony in such particles is preferably from about 1 to about 15 weight percent, based on total weight of the particles, and more preferably from about 3 to about 10 weight percent.

In addition to the zinc oxide filler, the outer layer 28 can further comprise, as an optional component, a particulate thermally-conductive filler material. Examples of thermally conductive fillers are those disclosed in U.S. Pat. No. 5,595,823, such as aluminum oxide, tin oxide, copper oxide, chromium oxide, iron oxide, and nickel oxide. Silica (silicon dioxide) can also be used, as well as silicon carbide and combinations of the foregoing materials. The particle size of the thermally conductive filler does not appear to be critical. Particle sizes anywhere in the range of 0.1 to 100 micrometers are acceptable. The amount of filler employed can be calculated, based on the desired thermal conductivity for the resulting material for outer layer 28, but where such thermally conductive filler is used, it is generally added in an amount of from about 10 to 140 pph by weight of the fluorocarbon thermoplastic random copolymer. Where thermal conductivity is desired, the amount of thermally-conductive filler added should be sufficient to yield an outer layer material having a thermal conductivity of from about 0.15 to about 0.40 BTU/hr-ft-° F., and more preferably from about 0.2 to about 0.35 BTU/hr-ft-° F., so as to minimize the thermal time constant for transferring heat to the fuser member 30 and/or pressure member 50 of FIGS. 1 and 2.

The thermally conductive filler employed, such as tin oxide or aluminum oxide particles, can be obtained from any convenient commercial source, e.g., Magnesium Electron, Inc. of Flemington, N.J.

For embodiments where the heater member includes an internal heat source (i.e., within the core 24), it is desirable that outer layer 28 have a relatively high thermal conductivity so that heat can be efficiently transmitted to the outer surface of the heater member. Depending upon the relative thickness for layers in such an embodiment, it is generally desirable that the base cushion layer and any other intervening layers employed in the heater member have a relatively high thermal conductivity. Suitable materials for the base cushion layer are discussed below.

Preferred cured fluorocarbon thermoplastic random copolymer compositions employed for the outer layer have a weight ratio of aminosiloxane polymer to fluorocarbon thermoplastic random copolymer of between about 0.01 and about 0.2 to 1 by weight, and preferably from between about 0.05 and about 0.15 to 1. The composition is preferably obtained by curing a mixture comprising from about 60–90 weight percent of a fluorocarbon thermoplastic random copolymer; about 5–20 weight percent, most preferably about 5–10 weight percent, of a curable amino-functional siloxane copolymer; about 1–5 weight percent of a bisphenol residue, about 1–20 weight percent of a zinc oxide acid acceptor type filler, and optionally about 10–50 weight percent of fluorinated resin, based on total weight of the composition.

To form the overcoat layer composition in accordance with the present invention, known solution coating methods can be used, wherein the filler particles, both reactive filler and any optional thermally-conductive filler as previously described, are mixed with uncured fluorocarbon thermoplastic random copolymer, aminosiloxane, a bisphenol residue curing agent, and any other additives, such as fluorinated resin, in an organic solvent such as methylethylketone or methylisobutylketone. The solution is then applied to a core (with base cushion layer already coated thereon), and thereafter allowed to cure as described hereinafter.

The fluorocarbon thermoplastic random copolymer is essentially cured by crosslinking with basic nucleophile addition curing. Basic nucleophilic cure systems are in general known and are discussed, for example, in U.S. Pat. No. 4,272,179. One example of such a cure system combines a bisphenol residue as the curing agent and an organophosphonium salt, as an accelerator. The curing agent is incorporated into the polymer as a cure-site subunit, for example, bisphenol residues. Other examples of nucleophilic addition cure systems are sold commercially as DIAK No. 1 (hexamethylenediamine carbamate) and DIAK No. 3 (N,N'-dicinnamylidene-1,6-hexanediamine) by Dupont.

Curing of the fluorocarbon thermoplastic random copolymer can be carried out at much shorter curing cycles compared to the well known conditions for curing conventional fluoroelastomer copolymers. For example, the curing of fluoroelastomers is usually from 12–48 hours at temperatures of about 220° to 250° C. Typically, such fluoroelastomer coating compositions are dried until solvent free at room temperature, then gradually heated to about 230° C. over 24 hours, then maintained at that temperature for 24 hours. By contrast, the cure of the fluorocarbon thermoplastic random copolymer compositions can be attained by heating the uncured mixture for as short as 3 hours at a temperature of 220° C. to 280° C. and an additional 2 hours at a temperature of 250° C. to 270° C. If antimony-doped tin oxide particles are employed, then the mixture can be cured at a temperature of as low as 25° C. over a period of at least about 2 hours.

The outer layer 28 desirably has a thermal conductivity of from about 0.15 to about 0.40 BTU/hr-ft-° F. to ensure that the outer layer has sufficient heat capacity to effectively conduct heat to fuser member 30. Thermal conductivity of the outer layer can also be adjusted by varying the thickness of the outer layer so as to obtain a desired level of thermal conductivity, or optionally, thermally-conductive fillers as described above, can be added to adjust thermal conductivity of the outer layer to a desired level. If a thin layer of cured fluorocarbon thermoplastic random copolymer is desired, then addition of thermally-conductive filler will generally be needed to obtain a thermal conductivity within the desired range. Thermal conductivity can be measured by the procedure and equipment described in ASTM Method F433-77.

The outer layer 28 should be at least about 4 mils (100 $\mu$m) in thickness to have a desirable amount of mechanical strength and/or heat storage capacity, and preferably it has a thickness of from about 4 mils (100 $\mu$m) to about 12 mils (300 $\mu$m), and more preferably from about 6 mils (150 $\mu$m) to about 8 mils (200 $\mu$m). At a thickness of greater than about 12 mils, the outer layer tends to act as a heat sink and transfer of heat to the fuser or pressure members is not as efficient.

In terms of hardness, the outer layer preferably has a Durometer hardness of greater than about 20 Shore A, and preferably from about 50 to about 80 Shore A as determined by accepted analytical methods known in the art, i.e., ASTM Standard D2240, as mentioned in U.S. Pat. No. 5,716,714, the relevant teachings of which are incorporated herein by reference.

Base Cushion Layer

The conformable base cushion layer 26 can be of any poly(organosiloxane), such as a poly(dialkylsiloxane), poly (alkylarylsiloxane), or poly(diarylsiloxane) as described in U.S. Pat. No. 5,587,245, the teachings of which are incorporated herein by reference, or a solid (non-foamed) fluoroelastomer material, such as Viton® fluoroelastomers available from DuPont of Wilmington, Del., or so-called interpenetrating networks of siloxane elastomers and fluoroelastomers as previously mentioned. Preferably, the base cushion is made of a poly(organosiloxane) polymer, since siloxane polymers are generally softer and more conformable relative to fluoroelastomers. Such poly(organosiloxane) polymers can be formed by condensation or addition polymerization.

In general, the poly(organosiloxane) material preferably employed for the base cushion layer 26 preferably comprises a polymerized reaction product of:

(a) at least one cross-linkable poly(organosiloxane);

(b) at least one cross-linking agent;

(c) optionally, an amount of at least one particulate filler; and (d) a cross-linking catalyst in an amount effective to react the poly(organosiloxane) with the cross-linking agent.

The polymerization employed may be a condensation-type reaction of hydroxy-substituted poly(organosiloxanes) materials, or addition polymerized reaction product of vinyl-substituted poly(organosiloxanes) with hydride-substituted cross-linking agents, as known in the art. Both types of polymerizations and starting materials are described hereinafter. Addition polymerization is preferred due to manufacturing and other processing advantages.

It is preferred to use a cross-linkable poly (dialkylsiloxane), and more preferably a poly (dimethylsiloxane), which, before crosslinking, has a weight average molecular weight of from about 10,000 to 90,000.

In preferred embodiments, the base cushion layer 26 comprises an addition polymerized poly(dialkylsiloxane). In this embodiment, the base cushion preferably comprises the addition polymerized reaction product of:

(a) at least one cross-linkable, poly(dialkylsiloxane), wherein the poly(dialkylsiloxane) is preferably a vinyl-substituted poly ($C_{1-8}$ alkylsiloxane) with terminal and/or pendant vinyl group functionality and a weight-average molecular weight before cross-linking of about 1,000 to about 90,000;

(b) from about 1 to about 50 parts by weight per 100 parts of poly (dialkylsiloxane) of finely divided filler;

(c) at least one cross-linking agent comprising a multifunctional organo-hydrosiloxane having hydride functional groups (Si—H) capable of reacting with the vinyl functional groups of the poly(dialkylsiloxane); and (d) at least one cross-linking catalyst present in an amount sufficient to induce addition polymerization of the poly(dialkylsiloxane) with the organo-hydrosiloxane cross-linking agent.

The addition-crosslinked poly(dialkylsiloxane) can be formed by addition polymerization of vinyl-substituted multifunctional siloxane polymers with multifunctional organo-hydrosiloxanes, as is generally described in U.S. Pat. Nos. 5,587,245 and 6,020,038, the teachings of which are incorporated herein by reference. Vinyl-substituted multifunctional poly(dialkylsiloxane) polymers and their preparation are known and, as used in the present invention, preferably have at least one of the following repeating subunits:

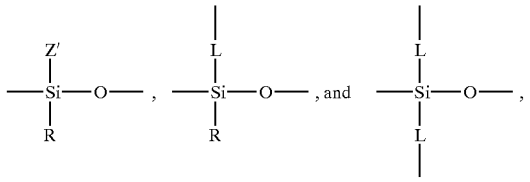

and terminal subunits having the general structure:

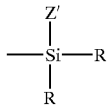

Designations, such as Z', R, and L, in all structural formulas herein, are used in a uniform manner and have the following meanings:

R is an alkyl having from 1 to 8 carbon atoms. More preferred are alkyl groups having from 1 to 6 carbons. Specific examples of R groups include: methyl, ethyl, propyl, and butyl, with methyl being most preferred. R groups can be substituted, however, the substituents should not degrade the characteristics of the resulting polymer. For example, R groups that react with olefins or organo-hydrosiloxanes are undesirable. Although minor amounts of aryl functionality can be incorporated into the polymer, it is generally not desirable to add a significant amount of aryl functionality into the poly(dialkylsiloxane) polymer, as the aryl functionality can inhibit the swelling of release agent.

Z is an olefinic group having from 2 to 8 carbons and a terminal vinyl moiety. Specific examples of Z groups include vinyl and allyl.

Z' represents Z or R, provided that each molecule of vinyl-substituted multifunctional siloxane polymer has two or more Z moieties (and thus 2 or more terminal vinyl groups).

L is —O— or —$(CH_2)_e$—, where e is an integer from 1 to about 8.

The vinyl-substituted multifunctional siloxane polymers can be represented, at least in so far as the currently preferred embodiments of the invention, by the general structure (referred to herein as "structure I"):

(I)

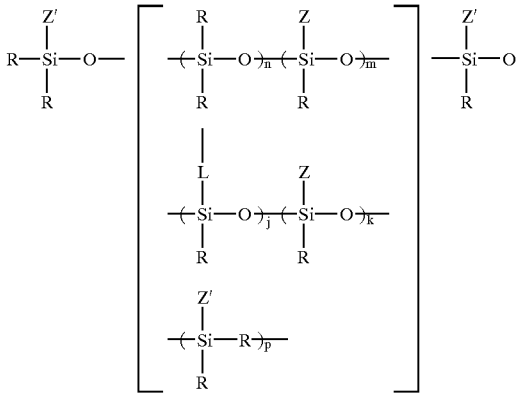

Each repeating subunit that has one or more L moieties (also referred to herein as branching subunits) which represents a branch point. Branches may extend outward in the form of a dendrite or star, or may form crosslinks to other chains. The value of p, the number of terminal units on branches, is equal to of less than the total number of branching units, j+2k, and may be as low as zero if all branching subunits form crosslinks.

The extent of branching or cross-linking of the siloxane polymer is low, since the resulting elastomer would otherwise be excessively hard. If n+m+j+k is defined as being equal to 100 mole percent; then j+k is less than 5 mole percent, and preferably is from 2 mole percent to 0 mole percent. The latter represents a preferred siloxane polymer, in which branching subunits are completely or substantially excluded. For this polymer, structure I can be simplified to the following (structure II):

(II)

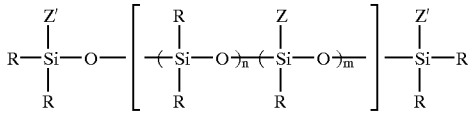

The siloxane polymer has at least two olefinic functionalities (in structures I or II; Z, or Z', or a combination of Z and Z'). The percentage of silicon atoms substituted by an olefinic moiety can be higher than two, but must be low enough to prevent the resulting elastomer from being excessively hard due to extensive crosslinking. It is preferred that the percentage of silicon atoms substituted by an olefinic moiety is less than about 3 percent of the total number of silicon atoms; or, more preferably, less than about 2 percent of the total number of silicon atoms.

In embodiments of the invention, the value of m is 0 or 1 and Z' is olefinic. In one such embodiment, structure II can be simplified as (structure III):

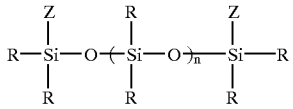

In other embodiments of the invention, Z' is R. In one such embodiment, structure II can be simplified as (structure IV):

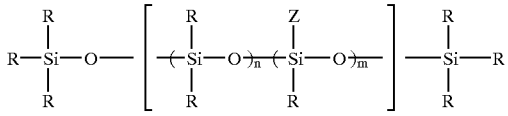

In particular embodiments of the invention, Z or Z' groups each have the general structure:

$$-(CH_2CH)-CH_2=CH_2$$

where d is an integer from 0 to about 6 and preferably from 0 to about 3. In one such embodiment, the siloxane polymer has the general structure (structure V):

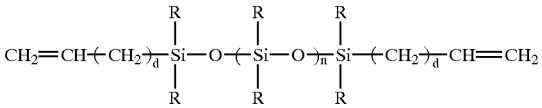

A specific example of such a preferred poly(dialkylsiloxane) polymer is a vinyldimethyl terminated polydimethylsiloxane, which has the general structure:

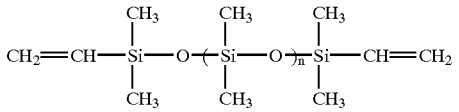

and a weight-average molecular weight of about 1,000 to about 90,000. These materials are commercially available from United Chemical Technologies, Inc., Piscataway, N.J., under various designations depending upon the viscosity and molecular weight desired.

In another embodiment, the siloxane polymer has the general structure (structure VI):

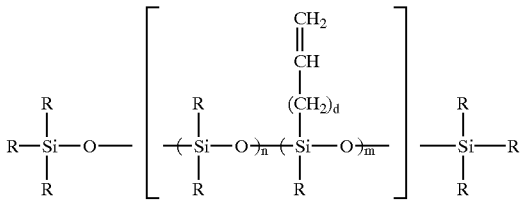

The designations n, m, and d have the same meanings as given above. A specific example of such a siloxane polymer is vinylmethyl siloxane copolymers in which each R is methyl.

In the structural formulas above, the values of n, or n+m, or n+m+j+k, are integers such that the respective polymer has a weight average molecular weight between vinyl groups of from 1,000 to 90,000. If the molecular weight between vinyl groups is above 90,000, the final crosslinked polymer would be too unstable under conditions of high temperature and cyclic stress (i.e., there would be too much creep and change in hardness over time), even when filler is dispersed therein. If the molecular weight between vinyl groups is below 1,000, the final cross-linked elastomer would have too high of a crosslink density that would make the material too hard and brittle.

In embodiments, the multifunctional organo-hydrosiloxanes that can serve as cross-linking agents for the structure I polymers have the general structure (structure VII):

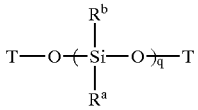

Each T represents:

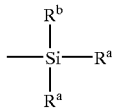

or both T's together represent atoms completing an organo-hydrosiloxane ring, such that structure VII can be rewritten as:

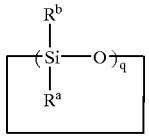

$R^a$ represents the same groups as R, i.e., $R^a$ can be alkyl having from 1 to 8 carbon substituents. Specific examples of $R^a$ groups include: methyl, ethyl, propyl, and butyl. $R^b$ represents H or $R^a$. At least two $R^b$ moieties are H. It is preferred that $R^a$ be methyl and that T be trimethylsilyl. The value of q is preferably from 3 to about 300. A specific example of a suitable multifunctional organo-hydrosiloxane is a material marketed as PS123, by United Chemical Technologies, Piscataway, N.J. This material has the general structure:

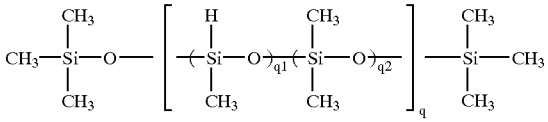

where $q^1+q^2=q$, and has a weight average molecular weight of from about 2,000 to 2,500. Another example is 1,3,5,7-tetramethylcyclotetrasiloxane, also available from United Chemical Technologies.

The addition cross-linking reaction is carried out with the aid of a compound including a late transition metal catalyst, such as cobalt, rhodium, nickel, palladium or platinum. Specific examples of such catalysts include chlorotris (triphenylphosphine) rhodium(I), $RhCl(Ph_3P)_3$; dicobaltoctacarbonyl, $Co_2(CO)_8$; and chloroplatinic acid, $H_2PtCl_6$. Chloroplatinic acid is preferred. In a particular embodiment of the invention, the catalyst is added as a complex with vinyl-terminated polysiloxane. Currently preferred is a platinum catalyst complex sold commercially as PC075 by United Chemical Technologies. This material is a complex of chloroplatinic acid and cyclovinylmethyl siloxane and has a platinum concentration of 2 to 3.5 percent by weight based on total weight of the mixture to be cured. It is also preferred that the PC075 complex be diluted with vinyl-terminated dimethylsiloxane polymer to provide a final platinum concentration of from 0.1 to 1000 parts per million (ppm), depending upon the desired cure rate. A suitable polysiloxane diluent is marketed by United Chemical Technologies as PS441.2 (viscosity=200 cts).

In preferred embodiments, the base cushion layer 26 comprises the crosslinked, addition-polymerized reaction product of a vinyl-terminated poly(dialkylsiloxane) and hydride-functional (Si—H) poly(dimethylsiloxane), provided that the molar ratio of vinyl to Si—H functional groups is from about 0.5:1 to about 5:1. The reaction is preferably conducted in the presence of a platinum curing catalyst with a weight ratio of platinum catalyst to poly (dialkylsiloxane) of from about $1\times10^{-3}$ to 1 to about $1\times10^{-6}$ to 1.

The filler is optional in the base cushion layer depending on whether thermal conductivity is desired therein. For example, if the heater member to includes an internal heat source as previously mentioned, it would be desirable to incorporate thermally conductive filler therein to facilitate transfer of heat through the base cushion layer. The thermally conductive filler can be selected from inorganic metal oxides, such as aluminum oxide, iron oxide, chromium oxide, tin oxide, zinc oxide, copper oxide and nickel oxide.

Silica (silicon dioxide) can also be used, as well as silicon carbide. The particle size of the filler does not appear to be critical. Particle sizes anywhere in the range of 0.1 to 100 micrometers are acceptable. The amount of filler employed can be from about 1 to about 50 parts by weight per 100 parts of the siloxane polymer.

A preferred commercially available material for forming a crosslinked, addition-polymerized, polyorganosiloxane is GE862 silicone rubber available from GE Silicones, Waterford, N.Y. or S5100 silicone rubber available from Emerson Cuming Silicones Division of W.R. Grace and Co. of Lexington, Mass.

Although less preferred, condensation-type poly (organosiloxanes) can be used to form base cushion layer 26. In this embodiment, the base cushion layer can comprise the condensation polymerized reaction product of:

(a) at least one cross-linkable, poly(organosiloxane) wherein the poly(organosiloxane) is preferably a hydroxy-substituted poly($C_{1-8}$ dialkylsiloxane) with terminal and/or pendant hydroxyl group functionality and a weight-average molecular weight before cross-linking of about 1,000 to about 90,000;

(b) from about 1 to about 50 parts by weight per 100 parts of the poly (organosiloxane) of finely divided filler;

(c) at least one multifunctional silane cross-linking agent having functional groups capable of condensing with the hydroxyl functional groups of the poly (organosiloxane); and (d) at least one cross-linking catalyst present in an amount sufficient to induce condensation polymerization of the poly(organosiloxane) with the multifunctional silane cross-linking agent.

Examples of preferred materials for use as a poly (organosiloxane), are condensable poly(dimethylsiloxanes) and fillers such as those disclosed in U.S. Pat. No. 5,269,740 (copper oxide filler), U.S. Pat. No. 5,292,606 (zinc oxide filler), U.S. Pat. No. 5,292,562 (chromium oxide filler), U.S. Pat. No. 5,548,720 (tin oxide filler), and U.S. Pat. No. 5,336,539 (nickel oxide), the teachings of which are incorporated herein by reference.

Preferred silanol-terminated poly(dialkylsiloxane) polymers and methods of their preparation are known and generally have the repeat unit structure (structure VIII):

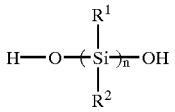

For purposes of the present invention, n in structure VIII is an integer such that the siloxane polymer has a weight average molecular weight before cross-linking of from about 1,000 to about 90,000. $R^1$ and $R^2$ are independently $C_{1-8}$ alkyl groups, such as methyl, ethyl, propyl, butyl, pentyl, and hexyl, and more preferably $R^1$ and $R^2$ are $C_{1-6}$ alkyls. $R^1$ and $R^2$ are more preferably methyl groups. If the molecular weight is below about 1,000, the final cross-linked network would have a high crosslink density that would make the material too hard and brittle, and not sufficiently conformable.

Silanol-terminated poly(dialkylsiloxanes) are also commercially available from United Chemical Technologies, Inc. of Piscataway, N.J.

The silanol-terminated poly(dialkylsiloxane) polymer can be cross-linked with multifunctional silanes. The multifunctional silanes that can serve as cross-linking agents for the structure VIII polymers are well known for this purpose. Each of such silanes comprises a silicon atom bonded to at least three groups that are functional to condense with the hydroxyl groups of the structure (VIII) polymers to thereby create siloxane crosslinks with the silicon atom of the multifunctional silane. The functional groups of the silanes can be, for example, acyloxy (R—COO—), alkenoxy ($CH_2$=C(R)O—), alkoxy (R—O—), dialkylamino ($R_2$ N—), or alkyliminoxy ($R_2$C=N—O—) groups, wherein R represents a $C^{1-12}$ alkyl group, preferably a $C_{1-6}$ alkyl. Some specific examples of suitable multifunctional silane cross-linking agents are methyltrimethoxysilane, tetraethoxysilane, methyltripropenoxysilane, methyltriacetoxysilane, methyltris(butanone oxime)silane, and methyltris (diethylamino)silane.

The condensation reaction is carried out with the aid of a catalyst, such as, for example, a titanate, chloride, oxide, or carboxylic acid salt of zinc, tin, iron, or lead. Specific examples of useful condensation catalysts are dibutyltin diacetate, tin octoate, zinc octoate, dibutyltin dichloride, dibutyltin dibutoxide, ferric chloride, lead dioxide, or mixtures of catalysts such as CAT50® catalyst sold by Grace Specialty Polymers of Lexington, Mass. CAT50®) catalyst is believed to be a mixture of dibutyltin dibutoxide and dibutyltin dichloride diluted with butanol.

Suitable fillers include those as previously described herein. While thermally conductive fillers can be used in the base cushion layer, in preferred embodiments which do not employ an internal heat source within the heater member core, it is preferred that use of such fillers be kept to a minimum such that base cushion layer 26 is relatively thermally insulating in nature. As such, heat transferred to the heater member is essentially maintained in the outer layer 28 and heat transfer to the fuser roller 30 is more efficient. Further, heat transfer to internal components of the heater member is reduced thereby enhancing component life or allowing for reduction in costs associated with such internal components.

To form the base cushion layer 26 of heater member 20 with a condensation cured poly(organosiloxane), at least one poly(organosiloxane), a stoichiometric excess amount of multifunctional silane to form crosslinks with the hydroxy or vinyl end groups of the poly(organosiloxane), and filler (if desired) as previously described are thoroughly mixed by any suitable method, such as with a three-roll mill as known to the art. The mixture is then degassed and injected into a mold surrounding the core to mold the material onto the core according to known injection molding methods. The so-treated core is kept in the mold for a time sufficient for some cross-linking to occur (e.g., generally at least about 4 hours) and allow the core to be removed from the mold without damage thereto. The so-coated member is then removed from the mold and maintained at a temperature of from about 25 to about 100° C. for at least about 1 hour so as to substantially complete reaction and/or accelerate remaining cross-linking.

To form the outer layer 28 as previously described hereinabove, the core 24 coated with the base cushion layer 26 is corona discharge treated to prepare the surface of the base cushion for application of the outer layer material. The outer layer 28 may then be directly applied thereto by forming a solution of the mixture comprised of uncured fluorocarbon thermoplastic random copolymer, aminosiloxane, bisphenol residue cure agent, zinc oxide, optional thermally conductive filler, and any other desired additives as described above. The solution is then applied to the base cushion coated core by known solution or ring coating methods, and cured as previously described hereinabove to obtain the desired product.

The conformable base cushion layer 26 can have a thickness that varies, but is preferably from about 125 mils (3.125 mm) to about 800 mils (20 mm) thick, and more preferably from about 250 mils (6.25 mm) to about 500 mils (12.5 mm) thick.

The base cushion layer 26 desirably has a hardness of from about 10 to about 50 Shore A, and preferably from about 20 to about 40 Shore A.

SPECIFIC EMBODIMENTS OF THE INVENTION

The following Examples further define and describe externally heated, external heater members according to the invention and are merely intended to illustrate specific embodiments of the present invention and should not be construed as limiting the scope thereof. Unless otherwise indicated, all parts and percentages are by weight and temperatures are in degrees Celsius (° C.).

EXAMPLE 1

Preparation of Heater Roller

A cylindrical solid stainless steel core having a length of 15.2 inches and a diameter of 1 inch is initially cleaned with dichloromethane and dried. The outer surface of the core is then primed with a uniform coat of a metal alkoxide primer, i.e., Dow 1200™ prime coat primer marketed by Dow Corning Corporation of Midland, Mich. which contains: light aliphatic petroleum naptha (85 weight percent), tetra (2-methoxyethoxy)-silane (5 weight percent), tetrapropyl orthosilicate (5 weight percent), and tetrabutyl titanate (5 weight percent). The core is then air dried.

A silicone base cushion layer is then applied to the so-treated core. Initially, a silicone mixture is first prepared by mixing in a three roll mill 100 parts of RTV S5100 A (a crosslinked poly(dimethylsiloxane) base compound) with 100 parts of RTV S5100B curing agent, both obtainable from Emerson Cuming Silicones Division of W.R. Grace and Co. of Lexington, Mass. The S5100 A base compound contains a vinyl-terminated poly(dimethylsiloxane) polymer with an effective amount, i.e., believed to be 10 to 100 ppm, of platinum as catalyst to initiate addition polymerization with a hydride-terminated siloxane polymer in the S5100 B curing agent, and also about 3 wt % of silica as filler per 100 parts of S5100 A and S5100 B employed. The cross-linking agent is a hydride-terminated siloxane. The S5100 B curing agent contains a vinyl-terminated poly(dimethylsiloxane) and a slight molar excess of hydride-terminated poly (dimethylsiloxane) to substantially react with the vinyl groups of the poly(dimethylsiloxane) in both the S5100 A base compound and S5100 B curing agent.

The above-described silicone mixture is then degassed and injection molded about the core in a mold, according to conventional injection molding methods. The mold is maintained at room temperature, i.e. a temperature of 25° C., for about 24 hours. The core with a coating of the silicone mixture thereon is then removed from the mold and placed in an oven wherein the temperature therein is ramped to 80° C. over a period of 30 minutes, followed by an 1 hour hold at 80° C. to substantially complete cross-linking. The so-coated core is then allowed to cool to room temperature, and the poly(dimethylsiloxane) base cushion layer is ground to provide a layer having a thickness of about 0.5 inches (500 mils). The base cushion is then subjected to corona discharge treatment at a power level of 300 watts for 1 minute.

Thereafter, an outer layer of cured thermoplastic fluorocarbon random copolymer is applied to the so-coated core. Initially, a fluorocarbon mixture is prepared by mixing in a two roll mill 100 parts of THV 200A fluorocarbon thermoplastic random copolymer, 6 parts of zinc oxide particles, 14 parts of aminosiloxane, and 30 parts of polytetrafluoroethylene (PTFE) resin. THV200A is commercially available fluorocarbon thermoplastic random copolymer sold by 3M Corporation of St. Paul, Minn. The zinc oxide particles are available from Atlantic Equipment Engineers of Bergenfield, N.J. The aminosiloxane is DMS-A21, commercially available from Gelest, Inc of Tullytown, Pa. The fluorinated resin, polytetrafluoroethylene (PTFE), is commercially available from Dupont of Wilmington, Del. The above-described mixture also includes 3 grams of Cure 50 also available from Dupont. The mixture is thoroughly mixed and then dissolved to form a 25 weight percent solution of the mixture in methylethylketone.

Part of the above-described solution is then ring coated by well known methods over the cured polysiloxane base cushion overlying the core. The so-coated core is then air dried for 16 hours, baked with 2.5 hour ramp to 275° C., given a 30 minute soak at 275° C., and then held 2 hours at 260° C. The resulting layer of cured fluorocarbon thermoplastic random copolymer has a thickness of 6 mils.

EXAMPLE 2

Evaluation of Heater Roller.

The heater roller prepared in Example 1 is then tested against a fuser roller as described hereinafter.

The fuser roller has a length of 15.2 inches and outer diameter of 2 inches, and consists of a cylindrical solid stainless steel core, with a 0.2 inch (200 mil) base cushion layer of the cured S5100 poly(dimethylsiloxane) and an outer layer of 0.0015 inch (1.5 mil) of cured fluorocarbon thermoplastic random copolymer thereover. The fuser roller is obtained by substantially following the procedures employed in Example 1 for preparation of the heater roller, except for the thickness of such materials applied to the core. The fuser core has a hollow interior portion wherein a halogen heat lamp is disposed for baseline heating of the fuser during operation in the fusing system described hereinafter.

Figure 5:
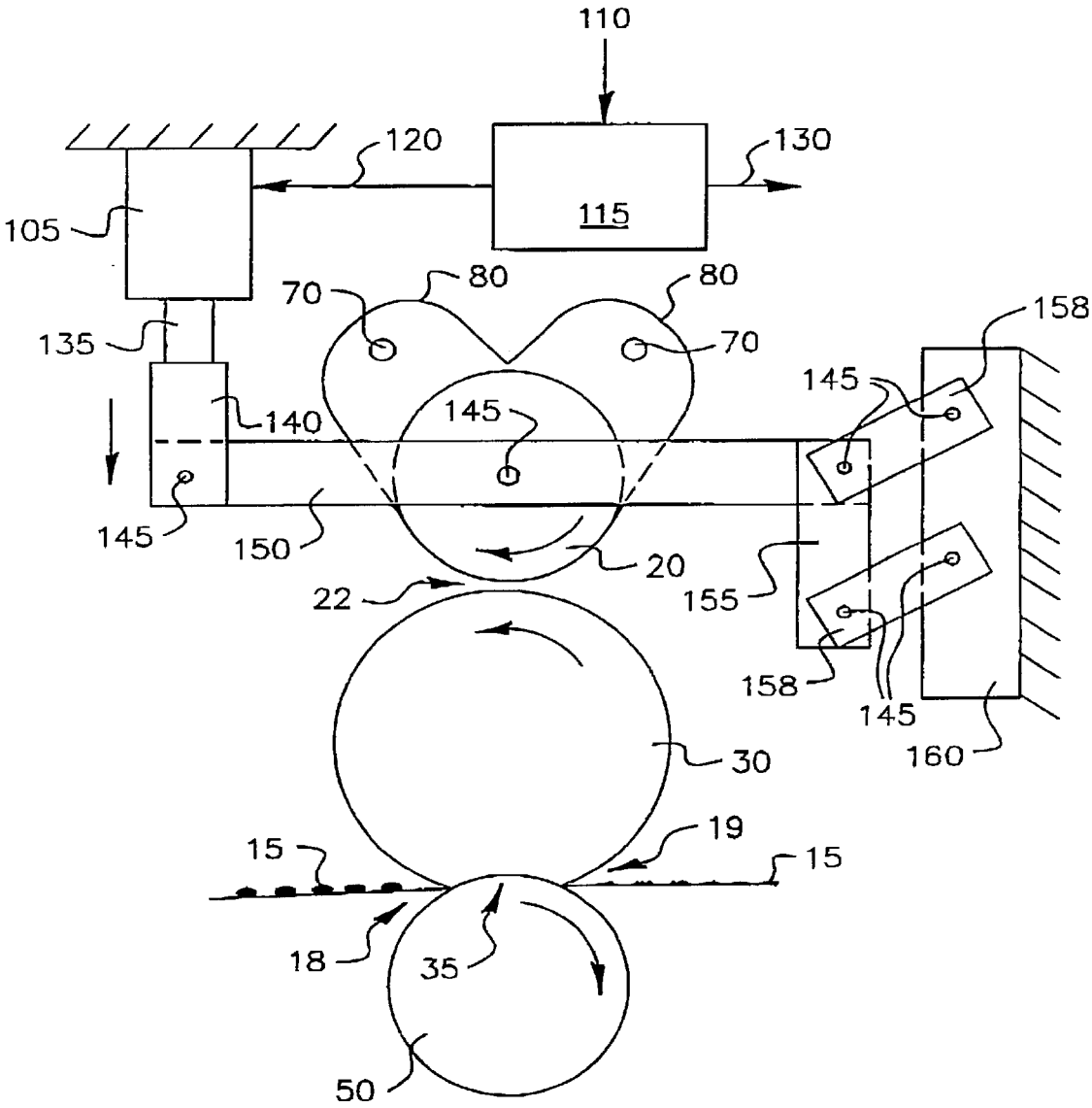
FIG. 5 is a schematic cross-sectional view of apparatus employed in Example 2 which comprises an external heater member.

The heater roller and fuser roller are installed into an electrophotographic machine having a two-pass fusing system similar to that described in FIG. 1, except as otherwise described hereinafter. The fusing system is also equipped with an externally heated, external heater member subsystem having an air actuated loading mechanism as shown in FIG. 5 and described more fully hereinafter. Reference numerals from FIG. 1 have been retained in FIG. 5 for clarity and convenience.

Referring now to FIG. 5, the external radiant heat source 70 employed consists of two carbon-filament infrared emitter elements available from Heraeus Amersil, Inc. of Duluth, Ga. having a total power of 3800 watts. A reflector 80 is shaped into a geometry as shown in FIG. 5, while radiation shielding is not shown for purposes of clarity. The air pressure actuated loading mechanism as shown in FIG. 5 is adapted to press the heater roller 20 against the fuser roller 30 and thereby create a nip 22 between the heater roller and the fuser roller, i.e., the contact nip.

In FIG. 5, the heater roller 20 is shown in a retracted position such that no contact is shown in the area of nip 22. To contact the heater roller and fuser roller, a fluid under pressure from a fluid source 110 (such as an air compressor not shown) is conveyed to a reservoir tank 115 which fluid is then conveyed by line 120 to a stationary pneumatic cylinder 105. Pneumatic cylinder 105 has a movable piston member 135 associated therewith and actuated by said fluid, which piston member is connected to one end of extension member 140 and travels in a direction as illustrated by the arrow adjacent to extension member 140. The other end of extension member 140 is rotatably connected to one end of transverse member 150 by use of a connector 145, which can be a rivet, pin, or the like. The other end of transverse member 150 is rotatably attached to one end of a linking member 155 by use of connector 145. Linking member 155 is attached to a stationary member 160 by use of two pivot members 158. Each pivot member 158 is rotatably connected at one end thereof (by using a connector 145) to one end of linking member 155, while the other ends of pivot members 158 are rotatably connected to stationary member 160 as shown in FIG. 5. With this arrangement, as the piston member 135 travels in a vertical direction as shown in FIG. 5, the heater roller similarly moves in a vertical direction without significant rotation. The transverse member 150 is attached to one end of heater roller 20 as shown by use of connector 145 such that the heater roller is capable of rotating freely as shown by the arrow within heater roller 20 of FIG. 5.

Another pneumatic cylinder, extension member, transverse member, linking member, pivot members, stationary member, and associated connectors (not shown in FIG. 5) are similarly provided for the other end of heater roller 20, so that the force exerted by heater roller 20 onto fuser roller 30 is maintained substantially uniform over the length of the two rollers. A line 130 similarly conveys fluid under pressure from reservoir tank 115 to the second pneumatic cylinder. By use of a common reservoir tank 115, the fluid pressure used to actuate the two pneumatic cylinders is maintained at essentially constant pressure in lines 120 and 130.

An applied load of 75 pounds per linear inch (pli) of heater roller length is applied by adding sufficient air pressure (about 90 psi) into the loading mechanism, which load produces a contact nip that is 16.7 mm wide. The fuser roller 30 has an internal 3000-watt halogen lamp available from Ushio America, Inc. of Cypress, Calif. that is used to heat the fuser core to prevent heat losses from the fuser roller surface to the core. A pressure roller 50 with an outer layer of cured fluorocarbon thermoplastic copolymer thereon having a thickness of 2.5 mils and base cushion of cured S5100 poly(dimethylsiloxane) having a thickness of 200 mils and prepared substantially as described in Example 1 above, is loaded against the fuser roller to form a second nip, i.e., the fusing nip 35 as illustrated in FIG. 5. Receiver media pass through the fusing nip, where heat and pressure fix the toner to the receiver surface, also as shown in FIG. 5.

Figure 6:
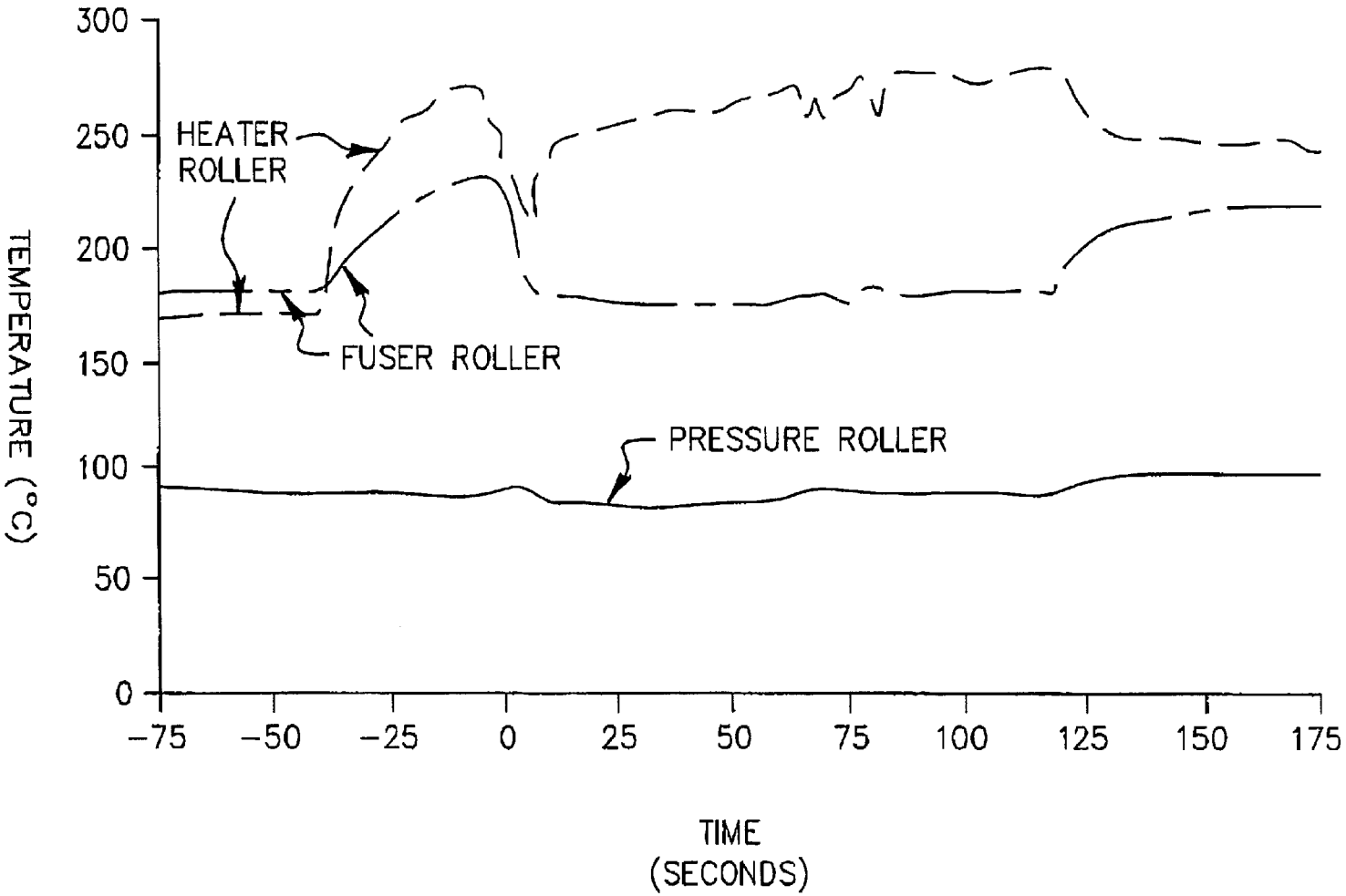
FIG. 6 is a graph illustrating data for Example 2 as described hereinafter.

The foregoing heater and fuser rollers are run in a test wherein paper receiver media are passed through the fusing system at a surface speed of 450 mm per second through the fusing nip. The toner laydown is such that it has an area density of 240 g/m$^2$on the media. The temperatures of the surfaces of the heater roller, fuser roller, and pressure roller are measured with an infrared pyrometer from just prior to the start of the test until the heater roller and fuser roller reach a steady state temperature, at which point, the test is discontinued. The results of the test are shown in FIG. 6. As can be seen, the heater roller reaches a steady-state temperature of 275° C. at a time of about 85 seconds after the start of the test. At this temperature, there is enough heat delivered by the heater roller through the contact nip that the fuser roller temperature drops no more than 6° C. from its set point of 180° C., despite the large amount of heat that is carried away from the fuser roller by the paper media passing through the fusing nip. During the transition from no media feed to steady media feed, there is no change in the heat supplied by the fuser roller internal lamp, signifying that the external heater roller is able to supply all of the heat absorbed by the media as it passes through the fusing nip.

EXAMPLE 3

Figure 7:
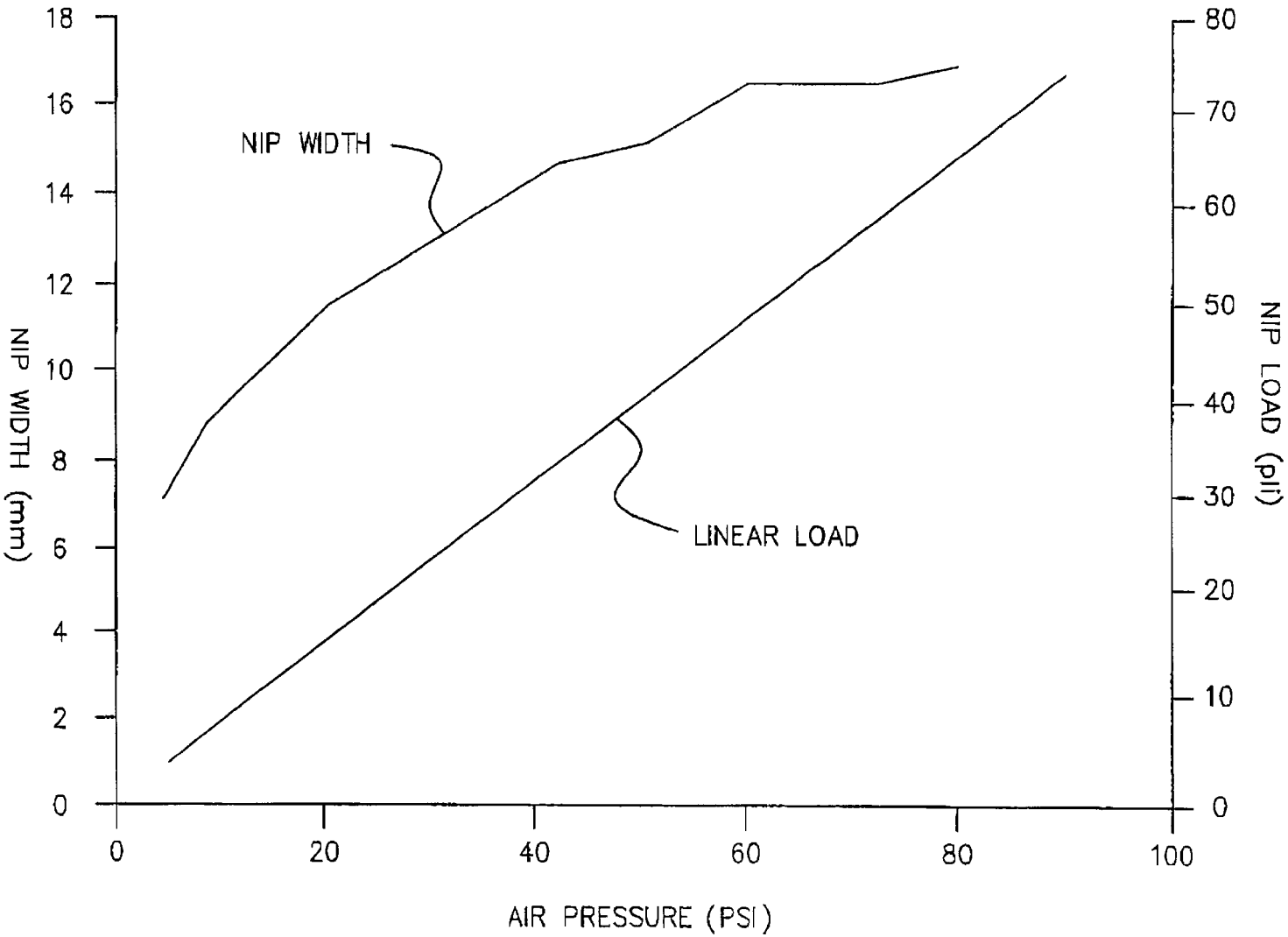
FIG. 7 is a graph illustrating data for Example 3 and showing the relationship between contact nip load in pounds per linear inch (pli) of contact nip length, applied air pressure in terms of pounds per square inch (psi), and contact nip width in millimeters (mm) for the externally heated external heater member subsystem as described in Example 2.

For the fuser system described in Example 2 above, the air pressure supplied to the loading mechanism is varied, with the power levels for heat sources being kept constant, such that the contact nip load and contact nip width are thereby varied. The data obtained for the particular rollers and the fuser system employed are shown in FIG. 7. As can be seen, the contact nip width can be varied from about 7 mm to about 17 mm by adjusting the air pressure supplied to the loading mechanism. In this way, the area of contact and therefore heat supplied to the fuser during operation can also be adjusted in order to change the fuser surface temperature rapidly during a document run so that fusion and gloss can be adjusted or tuned to media of different types in a document run.

EXAMPLE 4

The following table illustrates the upper service limit (temperature at which the material degrades and/or decomposes) for various materials, both those corresponding to the invention and some submitted for comparison purposes. As can be seen, the cured fluorocarbon thermoplastic random copolymer employed in Example 1 has a thermal stability equivalent to cured Kalrez® polymers, but is simpler to use and fabricate heater members corresponding to the invention as mentioned above. Nitrile, silicone, and fluorosilicone materials do not have upper service limits which are useful for typical fusing applications.

TABLE

| Material | Temperature Limit |
|---|---|
| Kalrez 4079 | 316° C. (600° F.) |
| Kalrez 3018 | 316° C. (600° F.) |
| Kalrez 1050LF | 290° C. (550° F.) |
| Kalrez 2035 | 218° C. (425° F.) |
| Kalrez 2037 | 218° C. (425° F.) |
| Nitrile | 107° C. (225° F.) |
| Silicone | 204° C. (400° F.) |
| Fluorosilicone | 190° C. (375° F.) |
| Cured Fluorocarbon thermoplastic Random copolymer of Example 1 | 300° C. (600° F.) |

Note: These limits are based on air oxidative stability.

Although the present invention has been described in detail with particular reference to the preferred embodiments recited above, it will be understood that variations and modifications can be effected within its scope and spirit.

What is claimed is:

1. A heater member for transferring heat to a fusing member used to heat fix a toner image to a substrate, the heater member comprising:

a core;

a conformable base cushion layer overlying the core; and an outer layer overlying the base cushion layer, the outer layer comprising a cured fluorocarbon thermoplastic random copolymer which is the reaction product of a mixture comprising a fluorocarbon thermoplastic random copolymer, a curing agent having a bisphenol residue, a particulate filler containing zinc oxide, and an aminosiloxane, the cured fluorocarbon thermoplastic random copolymer having subunits of:

$—(CH_2CF_2)x—$, $—(CF_2CF(CF_3)y—$, and $—(CF_2CF_2)z—$, wherein x is from 1 to 50 or 60 to 80 mole percent, y is from 10 to 90 mole percent, z is from 10 to 90 mole percent, x+y+z equals 100 mole percent.

2. The heater member of claim 1 wherein the aminosiloxane is an amino functional polydimethyl siloxane copolymer.

3. The heater member of claim 2 wherein the amino functional polydimethyl siloxane copolymer comprises amino functional units selected from the group consisting of (aminoethylaminopropyl) methyl, (aminopropyl) methyl and (aminopropyl) dimethyl.

4. The heater member of claim 1 wherein the aminosiloxane has a total concentration of from 1 to 20 parts by weight per 100 parts of the fluorocarbon thermoplastic random copolymer.

5. The heater member of claim 1 wherein the zinc oxide has a total concentration of from about 1 to about 20 parts by weight per 100 parts of the fluorocarbon thermoplastic random copolymer.

6. The heater member of claim 1 wherein the zinc oxide has a total concentration in the layer of from about 3 to about 15 parts by weight per 100 parts of the fluorocarbon thermoplastic random copolymer.

7. The heater member of claim 1 wherein the cured fluorocarbon thermoplastic random copolymer is cured by bisphenol residues.

8. The heater member of claim 1 wherein the cured fluorocarbon thermoplastic random copolymer is nucleophilic addition cured.

9. The heater member of claim 1 wherein x is from about 30 to about 50 mole percent, y is from about 10 to about 90 mole percent, and z is from about 10 to about 90 mole percent.

10. The heater member of claim 1 wherein x is from about 40 to about 50 mole percent and y is from about 10 to about 15 mole percent.

11. The heater member of claim 1 wherein z is greater than about 40 mole percent.

12. The heater member of claim 1 wherein the fluorocarbon thermoplastic random copolymer further comprises a fluorinated resin.

13. The heater member of claim 12 wherein the fluorinated resin has a number average molecular weight of between 50,000 and 50,000,000.

14. The heater member of claim 12 wherein the weight ratio of fluorocarbon thermoplastic random copolymer to fluorinated resin is from between about 1:1 to about 50:1.

15. The heater member of claim 12 wherein the fluorinated resin is polytetrafluoroethylene or polyfluoroethyleneepropylene.

16. The heater member of claim 1 wherein the base cushion layer comprises a fluoroelastomer.

17. The heater member of claim 1 wherein the base cushion layer comprises a siloxane elastomer.

18. The heater member of claim 17 wherein the siloxane elastomer comprises an addition-polymerized reaction product.

19. The heater member of claim 17 wherein the siloxane elastomer comprises the addition polymerized reaction product of:

(a) at least one cross-linkable, vinyl-substituted poly (dialkylsiloxane) with a weight-average molecular weight before cross-linking of about 1,000 to about 90,000;

(b) from about 1 to less than 5 parts by weight per 100 parts of poly(diakylsiloxane) of finely divided filler;

(c) at least one cross-linking agent comprising a multifunctional organo-hydrosiloxane having hydride functional groups capable of reacting with the vinyl functional groups of the poly(dialkylsiloxane); and (d) at least one cross-linking catalyst present in an amount sufficient to induce addition polymerization of the poly(dialkylsiloxane) with the multifunctional organo-hydrosiloxane cross-linking agent.

20. The heater member of claim 19 wherein the vinyl-substituted poly(dialkylsiloxane) is a vinyl-substituted poly ($C_{1-8}$ alkylsiloxane).

21. The heater member of claim 19 wherein the vinyl-substituted poly(dialkylsiloxane) comprises repeating units with the following structural formulas:

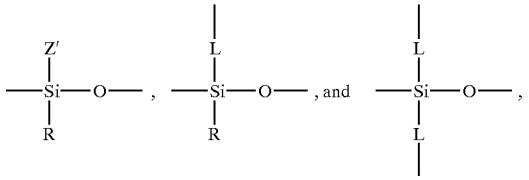

and terminal subunits having the general structure:

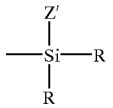

wherein:

R is an alkyl having from 1 to 8 carbon atoms;

Z is an olefinic group having from 2 to 8 carbon atoms and a terminal vinyl moiety;

Z' can be Z or R, provided that each molecule of vinyl-substituted poly(dialkylsiloxane) polymer has two or more Z moieties; and L is —O— or $—(CH_2)_e—$, where e is an integer from 1 to about 8.

22. The heater member of claim 19 wherein the vinyl-substituted poly(dialkylsiloxane) is a vinyl-substituted poly (dimethylsiloxane) having the formula:

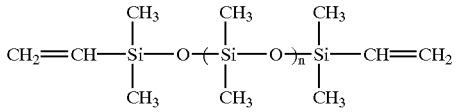

wherein:

n is an integer such that the vinyl-substituted poly (dimethylsiloxane) has a weight average molecular weight of from about 1,000 to about 90,000.

23. The heater member of claim 19 wherein the multifunctional organo-hydrosiloxane corresponds to the formula:

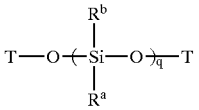

wherein each T represents:

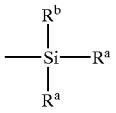

or both T's together represent atoms completing an organo-hydrosiloxane ring;

$R^a$ is alkyl having from 1 to 8 carbon atoms;

$R^b$ is H or $R^a$, provided that at at least two $R^b$ moieties are H; and q is from 3 to about 300.

24. The heater member of claim 19 wherein the filler is selected from aluminum oxide, iron oxide, tin oxide, zinc oxide, copper oxide, or silica.

25. The heater member of claim 19 wherein the filler is silica.

26. The heater member of claim 19 wherein the silicone material comprises from about 1 to about 4 parts by weight of a finely divided filler per 100 parts of the crosslinkable vinyl-substituted poly(diaklysiloxane).

27. The heater member of claim 1 wherein the base cushion layer is from about 125 mils to about 800 mils thick.

28. The heater member of claim 1 wherein the base cushion layer is from about 250 mils to about 500 mils thick.

29. The heater member of claim 1 wherein the base cushion layer has a hardness of from about 10 to about 50 Shore A.

30. The heater member of claim 1 wherein the base cushion layer has a hardness of from about 20 to about 40 Shore A.

31. The heater member of claim 1 wherein the outer layer is from about 4 mils to about 12 mils thick.

32. The heater member of claim 1 wherein the outer layer is from about 6 mils to about 8 mils thick.

33. The heater member of claim 1 wherein the outer layer has a hardness of greater than about 20 Shore A.

34. The heater member of claim 1 wherein the outer layer has a hardness of from about 50 to about 80 Shore A.

35. The heater member of claim 1 wherein the outer layer comprises at least one thermally conductive filler.

36. The heater member of claim 35 wherein the at least one thermally conductive filler includes at least one particulate metal oxide.

37. The heater member of claim 36 wherein the at least one metal oxide includes aluminum oxide, tin oxide, copper oxide, or mixtures thereof.

38. The heater member of claim 36 wherein the at least one particulate metal oxide includes aluminum oxide.

39. The heater member of claim 36 wherein the at least one particulate metal oxide filler is present in an amount of from about 10 to about 140 parts per 100 parts of the fluorocarbon thermoplastic random copolymer.

40. The heater member of claim 12 wherein the fluorinated resin has a number average molecular weight of from about 200,000 to about 1,000,000.

41. The heater member of claim 12 wherein the fluorinated resin is present in an amount of from about 10 wt % to about 50 wt % based on total weight of the outer layer.

42. The heater member of claim 1 wherein said fluorocarbon thermoplastic random copolymer further comprises a curing agent.

43. The heater member of claim 42 wherein the curing agent is a bisphenolic residue.

44. The heater member of claim 36 wherein the at least one particulate metal oxide has an average particle size of from about 0.5 micron to about 40 micron.

45. The heater member of claim 1 wherein the core is cylindrical and made of metal.

46. The heater member of claim 45 wherein the metal is steel or stainless steel.

47. A heater member for transferring heat to a fusing member used to heat fix a toner image to a substrate, the heater member comprising:

a core;

a conformable base cushion layer overlying the core; and an outer layer overlying the base cushion layer, wherein the outer layer comprises a cured fluorocarbon thermoplastic random copolymer.

* * * * *